United States Patent [19]

Fauvel et al.

[11] Patent Number: 4,754,706

[45] Date of Patent: Jul. 5, 1988

[54] MUNITION SCATTERING PROJECTILE

[75] Inventors: Jean-Robert Fauvel, Muret; Philippe Rousseau, Paris; Pierre Thebault, Saint Agne; Daniel Van Schendel, Muret, all of France

[73] Assignee: Etienne Lacroix Tous Artifices, Muret, France

[21] Appl. No.: 5,319

[22] Filed: Jan. 15, 1987

Related U.S. Application Data

[63] Continuation of Ser. No. 624,832, Jun. 26, 1984, abandoned.

[30] Foreign Application Priority Data

Jun. 27, 1983 [FR] France ..... 83 10574

[51] Int. Cl.[4] ..... F42B 13/50

[52] U.S. Cl. ..... 102/489; 102/501

[58] Field of Search ..... 102/340, 342, 351, 357, 102/384, 388, 378, 393, 438, 489, 501, 505

[56] References Cited

U.S. PATENT DOCUMENTS

| | | | |
|---|---|---|---|
| 1,017,928 | 2/1912 | Tocik | 102/506 |
| 2,874,639 | 2/1959 | Cardiff | 102/393 |
| 3,119,298 | 1/1964 | Brown | 102/378 |
| 3,119,302 | 1/1964 | Barr | 102/378 |
| 3,143,965 | 8/1964 | La Pointe | 102/505 X |
| 3,712,229 | 1/1973 | Schock | 102/489 |
| 3,818,833 | 6/1974 | Throner, Jr. | 102/393 |
| 3,946,672 | 3/1976 | Adams et al. | 102/393 |
| 4,242,960 | 1/1981 | Boeder et al. | 102/506 |
| 4,498,393 | 2/1985 | Fischer et al. | 102/393 |
| 4,549,489 | 10/1985 | Billard et al. | 102/505 |

FOREIGN PATENT DOCUMENTS 516849 6/1979 U.S.S.R. .

*Primary Examiner*—Harold J. Tudor

[57] ABSTRACT

A projectile for scattering munitions, wherein the projectile comprises:

a plurality of individual munitions (4) disposed axially in a separable manner in a single stack, said munitions being generally flat in shape and having shaped upper and lower surfaces which are complementary to enable the stacked munitions to interfit; maintaining means (5) for fixing together the munitions in the stack to constitute a stack which is undeformable against axial and transverse forces, thus providing a self-supporting structure for constituting the body of the projectile; and release means for simultaneously unfixing all the munitions from one another and enabling them to be scattered.

8 Claims, 4 Drawing Sheets

MUNITION SCATTERING PROJECTILE

This is a continuation of copending application Ser. No. 624,832 on June 26, 1984 now abandoned.

The present invention relates to a projectile for scattering munitions.

BACKGROUND OF THE INVENTION

Such munitions, also referred to hereinafter as scatterable charges, are intended to be thrown randomly onto the ground from a release point situated at a certain distance above the ground. The munitions then fall on the ground where they roll and bounce, . . . , and eventually come to rest. They may comprise mines that are put into an active position, i.e. that are armed from the pyrotechnical point of view, after they have impacted the ground. Although the following description refers to a preferred application in which a zone is mined, this application is not limiting and the invention is applicable to scattering other types of munition.

Scattering supposes that a plurality of charges are carried together by a launch vector, and are then thrown out or released simultaneously.

It is generally desirable to group the charges in a mining zone which is both accurately localized and narrow, especially in depth. To do this, it is necessary for the different charges to be released at time intervals which are short as possible, thereby ensuring that the origins of their various individual trajectories are as close as possible (ideally the origins would all be at a single point for charges that are released simultaneously). It is also necessary for the ballistic characteristics (modulus and direction of the velocity vector) of each charge to present as little scatter (in the statistical sense) as possible. It is the dispersion of these characteristics that determines the narrowness of the zone which is mined. Further, it is absolutely essential to avoid any collisions between the mines at the moment of simultaneous scattering. The closer one tries to group the mines, the more difficult it is to satisfy this essential condition. Very close control must therefore be provided over the differential speeds of the mines.

Known devices having a oontainer from which the chores are ejected successively do not satisfy all these criteria, even if the total time taken for all successive ejections is very short. The same is true when the charges are released from a container because of the time taken to open the container and to extract the munitions, and this time can prejudice the accuracy and the reproducibility of a shot.

West German patent publication No. 2,607,336, for example, describes such a projectile in which the individual munitions are housed and maintained by an outer casing or "skin" formed by two half shells whioh are hinged to one another and which constitute the body of the projectile per se. Other containers for scatterable munitions are also described in West German patent publication No.2,340,653 (corresponding to U.S. Pat. No. 3,818,833) and in French patent publication No. 2,140,693.

One of the aims of the present invention is to provide a projectile whose charge is so disposed that scattering takes place in an entirely reproducible manner without requiring a container or casing.

Further, good reproducibility requires low altitude scattering to reduce the influence of parameters linked to the munitions own ballistics; the munitions should have just enough time to move away from one another before hitting the ground. Further, in addition to having a low altitude scattering point, it is desirable for the speed to be high enough and only slightly inclined relative to the horizontal.

Preferred embodiments of the present invention provide highly accurate control both in time and in space and are compatible with low altitude scattering at high speed. To this end the invention provides a new organization for the payload which avoids the drawbacks encountered with scatterable munitions carried by a container.

SUMMARY OF THE INVENTION

The present invention provides a projectile for scattering munitions, wherein the projectile comprises:

a plurality of individual munitions disposed axially in a separable manner in a single stack, said munitions being generally flat in shape and having shaped upper and lower surfaces which are complementary to enable the stacked munitions to interfit;

maintaining means for fixing together the munitions in the stack to constitute a stack which is undeformable against axial and transverse forces, thus providing a self-supporting structure for constituting the body of the projectile; and release means for simultaneously unfixing all the munitions from one another and enabling them to be scattered.

Most advantageously, means are additionally provided for preventing the individual munitions from rotating relative to one another, at least in one direction, about the axis of the stack, so as to transmit and share out the centrifugal forces to which the projectile is subjected.

The combination of the two characteristics of interfitting individual munitions in a stack and of subjecting the entire stack to the effect of retaining means provides a self-supporting structure having its own rigidity without requiring an additional outer skin nor any other type of container structure.

This ensures:

from a purely static and mechanical point of view: that the projectile is undeformable, i.e. it is self-supporting; and from a dynamic point of view: that acceleration and centrifugal forces are transmitted and shared out over the body of the projectile, thereby ensuring unitary ballistic and aerodynamic behaviour identical to that of a homogenous projectile (of the type that carries its munitions in a container).

Subsidiarily, since the outer skin of the projectile is constituted merely by the outer skin of the individual munitions, the payload/volume ratio of the projectile is maximized, particularly since the outside dimensions of the projectile are generally imposed a priori e.g. by the caliber of the artillery tube if the projectile in accordance with the invention is an artillery shell.

Preferably, the projectile generally comprises:

a base element disposed under the bottom munition of the stack; and a nose element disposed on top of the top munition of the stack.

In this case, the above-mentioned means for preventing the munitions from rotating relative to one another, also hold them fast relative to the end elements (i.e. the base and the nose elements).

In a first embodiment of the maintaining means, they are constituted by means holding the nose element to the base element so as to make the assembly constituted by the said elements and the stack undeformable.

In another embodiment of the maintaining means, they are suitable for connecting each individual munition to the adjacent munition in a manner that is separable on actuation of the release means.

The stack is no longer compressed overall as in the preceding case (where the individual munitions are compressed by applying tension between the nose element and the base element), but step-by-step by a series of links between adjacent munitions.

In the first embodiment of the maintaining means, they advantageously comprise at least two lateral arms each having one end connected either to the base element or to the nose element by locking means which co-operate with the release means.

Preferably, the other end of each of the lateral arms is hinged to the other element (i.e. the nose element or the base element) to enable the arm to pivot away from the stack in a direction transversal thereto.

Release is thus performed both absolutely simultaneously for all the charges, and also quasi-instantaneously by virtue of the fact that the munitions are simply stacked and are not interfastened in some way that would require some minimum operating time for unfastening means.

Further, the means for connecting the nose element to the base element advantageously include cable ducts for transmitting data and power, at least between one of the base and nose elements and each munition in the stack. These cables can be used for example, to charge the mines electrically and to load operating parameters therein (e.g. the time delay between impact and activation, the duration of activation, . . . ) just before firing them. The electrical power and the data may be transmitted from the nose element, via the lateral arms to igniters in each of the mines. The lateral arms may also serve for transmitting data between the base element and the nose element (e.g. when the nose element includes guidance means for controlling propellant in the base element). The fact that the projectile body is constituted by a bare stack prevents cables from passing between its nose and its base inside the body of the projectile as would be case where the projectile included a rigid body casing.

Advantageously, in the case of a propelled projectile, the projectile further includes sequencing means for successively:

controlling propulsion during a predetermined duration for a propelled phase;

at the end of the predetermined duration of a ballistic phase causing the propulsion unit to separate from the base element and causing a brake parachute (if any) to be deployed by the base element; and after a predetermined duration of the braking phase, causing the locking means to unlock.

The durations of the propelled phase, the ballistic phase, and the braking phase, are so chosen that, at the end of the braking phase, the projectile has a position, an orientation and a speed relative to the target all having set values that are independent of the situation of the firing point, thereby ensuring that the munitions are reproducibly scattered from one shot to the next.

It is also possible to provide a landing sequence such that at the end of braking, the munitions are always released at the same distance from the target and at the same altitude (which should be as low as possible).

BRIEF DESCRIPTION OF THE DRAWINGS

Embodiments of the invention are described, by way of example, with reference to the accompanying drawings, in which.

MORE DETAILED DESCRIPTION

Figure 1:
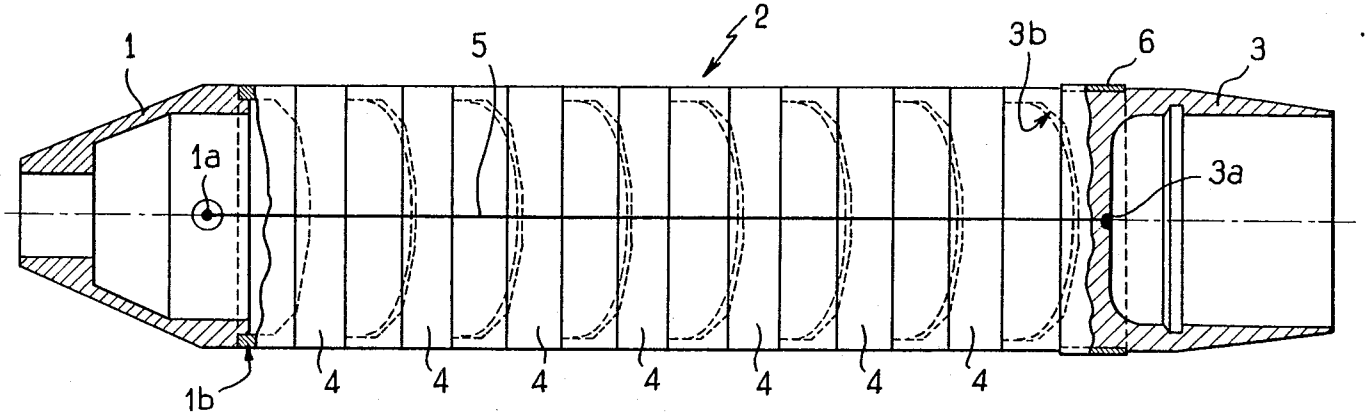
FIG. 1 is a partially cut-away elevation view of an artillery shell in accordance with the invention.

FIG. 1 shows a first embodiment of a projectile in accordance with the invention. This projectile is an artillery shell, comprising a nose element 1, a central body 2, and a base element 3.

The central body 2 is constituted by a bare stack of a plurality of scatterable charges 4 which are superposed on one another and which partially interfit.

The munitions may be anti-tank mines for example, or combined anti-tank and anti-personnel mines. They are suitable for scattering. They are so shaped that they may be stacked, e.g. by being in the form of mines having two parts **4*a* and 4*b* which are hinged together (see FIG. 2 which shows two mines stacked one on the other) and which are opened after impact with the ground in such a manner as to enable the anti-tank mine (contained in one of the hinged parts) to be correctly positioned and to enable anti-personnel mines enclosed therein to be scattered. The munitions can be stacked on one another because they have matching surfaces 4*c* and 4*d* with the surface 4*c* being concave and the surface 4*d*** being convex.

Mines of this type are described in the present Applicant's French patent application Nos. 83-10572 and 83-10573 to which reference should be made for a more complete description. However, this type of munition is in no way limiting, and the invention is applicable to scattering any type of munition, whether mines or otherwise, so long as they can receive one another to form an interfitting stack.

The stack is held together by an axial cable 5 connected at one end to a point **1*a* on the nose element and at the other end to a point 3*a*** on the base element. It is tightened to compress the stack between said end elements. At the moment of scattering, the cable is released, e.g. by conventional pyrotechnical means.

The clamping effect of the cable ensures that the projeotile is undeformable as a whole when subjected to axial and transverse forces (particularly due to the accelerations that take place during firing and during the ballistic phase). It may be observed that the nose element is provided with a groove 1*b* enabling it to be fitted to the top munition, and that the base element has a concave profile 3*b* for receiving the convex face 4*d* of the bottom munition in the stack.

Further, the projectile needs to be protected against very high centrifugal forces to which it is subjected to stabilize its trajectory. To do this, the base element is provided in conventional manner with a belt 6 for engaging the rifling of the gun barrel.

Figure 2:
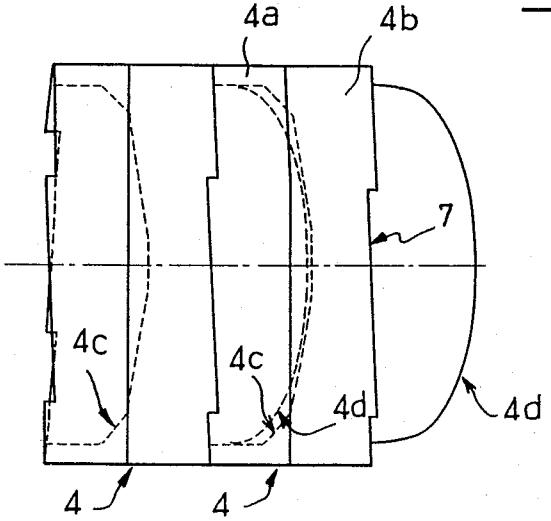
FIG. 2 is an elevation of a portion of the shell showing how two individual munitions are stacked therein.

Numerous means may be envisaged for preventing the munitions from rotating relative to one another, thereby transmitting the forces to all of the projectile. FIG. 2 shows slopes 7 provided on the periphery of the munitions for performing this function. They transmit torque in one direction only and provide no hinderance when the stack is released to scatter the munitions. Naturally, the base element is provided with a similar slope for transmitting torque to the stack.

Another particularly advantageous feature of such slopes is to enable the individual munitions to be scattered axially at the moment of release simply be applying a torque in the opposite direction to that imposed by the rifling (e.g. by suitable conventional pyrotechnical means). The effect of the slopes is to transform the applied torque into an axial force for separating the parts of the stack from one another.

In a variant, (see FIG. 3), the munitions are prevented from relative rotation by means of peripheral pegs 8. The pegs must nevertheless enable the parts they interconnect to separate easily in the axial direction, and their sole function is to prevent the various parts of the projectile from rotating relative to one another.

The number of pegs and their dimensions, or in the preceding case the length and the height of the slopes, are calculated for transmitting the very high torque imposed by the rifling giving a projectile a speed of rotation which may well be as much as 2000 revolutions per minute.

The fact that the maintaining means is in the form of an axial cable has the advantage that it is practically unaffected by centrifugal forces, which is quite different from what would have been the case if peripheral cables had been used. This characteristic is particularly advantageous for an artillery projectile which rotates at high speed.

In another embodiment of the maintaining means, the overall link between the nose element and the base element (i.e. the axial cable 5 shown in FIG. 1, or a like member) is replaced by a series of link means between adjacent munitions, with the overall assembly being held together by an accumulation of little links rather than by any overall effect.

Figure 3:
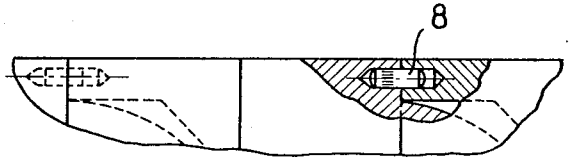
FIG. 3 is a detail view showing a peg for preventing the mines from rotating.
Figure 4:
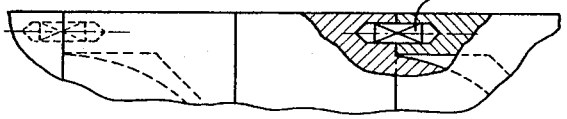
FIG. 4 is a similar view to FIG. 3, for an embodiment in which the locking pegs also constitute the maintaining means.

For example, the link means may be explosive pins 9 (see FIG. 4) which replace the peripheral pegs 8 shown in FIG. 3. Unlike the peripheral pegs 8, the explosive pins 9 must hold the assembly against axial forces as well as against torque. The release means are then in form of means for simultaneously igniting all the explosive pins of the projectile. Apart from doing without the axial cable 5, the structure of the projectile remains practically identical to the previous structure.

Figure 5:
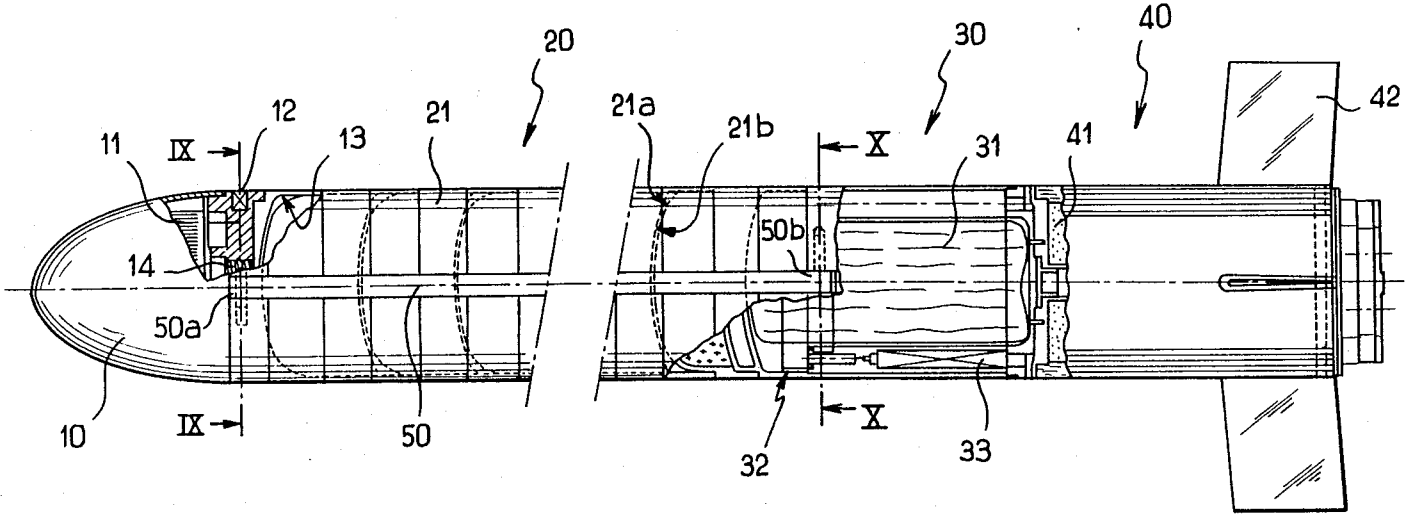
FIG. 5 is a partially cut-away elevation of a self-propelled munition in accordance with the invention.

FIG. 5 is an elevation of another embodiment of a projectile in accordance with the invention. It is in the form of a rocket-propelled stack of scatterable charges, but this application is not limiting. The projectile need not have its own propulsion means, it could simply be in the form of a braked bomb that is carried by an airplane or in an air-carried releasable container.

The projectile comprises a nose cone 10 which constitutes the nose element, a bare stack 20 of a plurality of scatterable charges 21, a base element 20, and finally a propulsion stage 40. The stack 20 is held together by lateral arms 50 which may optionally be rigid and which constitute maintaining means.

The maintaining means could be differently constituted, in particular, the various means described for the preceding embodiments could be used (e.g. an axial cable interconnecting the nose element and the base element or a series of step-by-step fastenings such as explosive pins). Likewise, the details of the means for preventing the parts of the stack from rotating relative to one another (slopes or circumferential pegs) are not described a second time, but remain just as applicable.

The nose element 10 includes an electronics box 11 for sequencing the operation of the projectile in a manner explained below. An outside connector 12 enables electrical charging shortly prior to firing, and also enables data to be fed into the electronics box 11 from the outside. The electronics box then distributes the electrical charge and the data (together with data it has itself derived therefrom) to each of the individual munitions 21 via each of the lateral arms 50 which provide ducts for cables serving all the mines. Further, the cable ducts provide a path from the nose element 10 to the base element 30 and thence to the propulsion unit 40.

The lower surface 13 of the nose element is shaped to stack in interfitting arrangement with the top munition of the stack. Further, it is provided with a spring 14 for facilitating ejection of the nose element to a distance from the stack at the moment of release.

The stack 20 is constituted by individual munitions 21, having matching top surfaces 21*a* and bottom surfaces 21*b* for interfitting stacking. The stacking and the means for preventing relative rotation are the same as for the embodiments described above with reference to FIGS. 1 to 4. Here too, the munitions may advantageously be of the types described in French patent application Nos. 83-10572 and 83-10573. Further, so far as obtaining the results aimed at by the invention are concerned, it does not matter whether the munitions have their convex or their concave surfaces pointing forwards, so long as the entire stack including the end elements interfits properly.

The base elements 30 preferably includes a parachute 31 for braking the projeotile in a manner explained below. The top surface 32 of the base element 30 is shaped to fit inside the bottom surface of the bottom mine in the stack. Further, the base element also includes a pyrotechnical extractor 33 suitable for separating the base element from the propulsion unit 40, which separation takes place at the same time as the parachute is opened.

The propulsion stage 40 is for example a solid fuel rocket 41 which includes stabilizing fins 42, e.g. on hinges for reducing the space taken up in the launching tube.

In a variant, the base element may itself be vaned, like a bomb, and it may include a base fuse and fan for arming.

The lateral arms 50 have both a mechanical function (keeping the stack together) and an electrical function (charging electrical power and conveying data). Their ends 50*a* are connected to the nose element 10 and their opposite ends 50*b* are connected to the base element 20.

Figure 9:
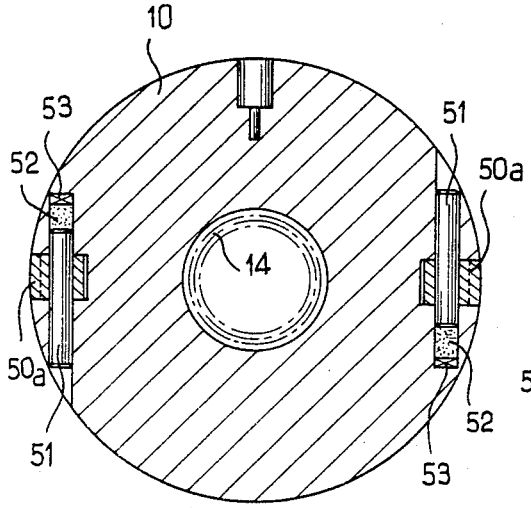
FIGS. 9 and 10 are cross sections through the projectile on lines IX—IX and X—X respectively in FIG. 5.
Figure 10:
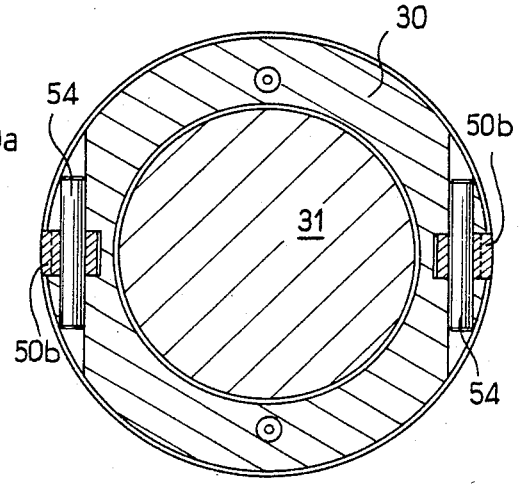

FIGS. 9 and 10 show the details of how the arm ends are connected. The connections to the nose element 10 (FIG. 9) are made by ejectable pins 51, which are ejected, for example, by means of explosive charges 52 triggered by detonators 5. Activating the detonators will cause quasi-instantaneous disconnection of the nose element 10 from the stack 20, with disconnection being accelerated by a spring 14.

The bottom ends **50*b* of the arms are connected to the base element 30 (FIG. 10) by non-ejectable pins 54 which hinge the arms to the base element 30**.

Although the figures show a two-arm embodiment. this number is not limiting; further, the arms need not be rigid. For example, the maintaining means could be constituted by flexible straps stretched between the base element and the nose element to keep the stack in compression.

Finally, it may be observed that the side arms are received in longitudinal grooves in the munitions (visible in FIGS. 9 and 10) and that this serves both the prevent the parts of the stack from rotating relative to one another and to keep a generally cylindrical outside shape, without the arms projecting out therefrom.

The sequence of operations for using such a projectile is now described.

Firstly, shortly before firing, each of the mines is electrically charged (charging a capacitor or a microbattery) and programmed with its operating parameters (time delay before arming, . . . ). These electrical parameters which are inserted via a single point 12 of the nose element and are then distributed to the various mines by the arms 50 which constitute cable ducts. Further, the ballistic data (range, firing angle, . . . ) are recorded in the electronics box 11 to enable proper sequencing of the various phases from the moment of firing to mine scattering.

Figure 6:
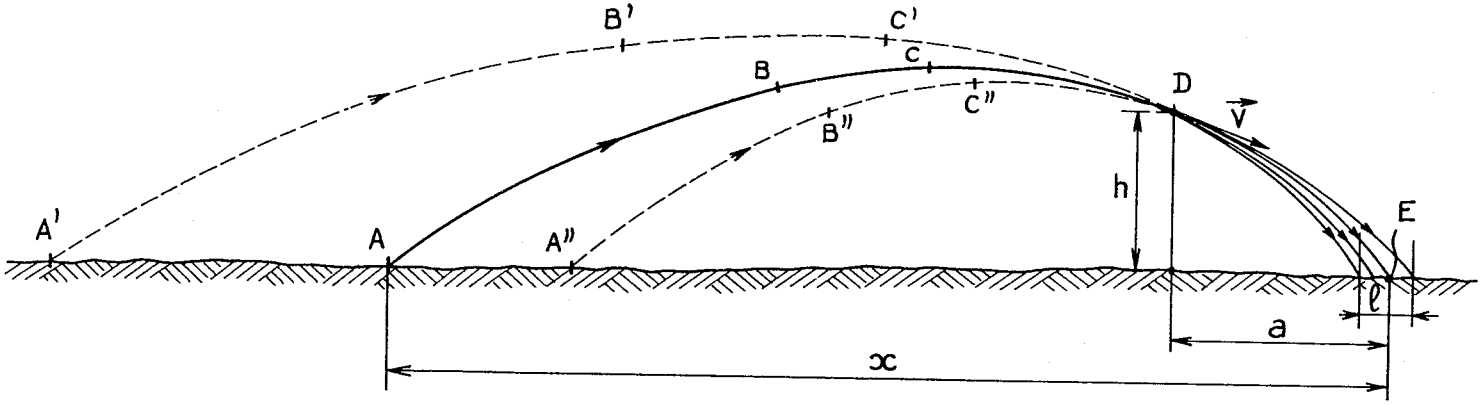
FIG. 6 is a diagram showing the trajectory of a particular projectile.

The various phases of the trajectory are shown diagramatically in FIG. 6: this figure shows a first or propelled phase AB corresponding to the time that the rocket operates. The projectile then continues on its trajectory during a ballistic phase BC, after which a braking phase CD is triggered to reduce the speed of the projectile. Point D is the scatter point, and at this point the projectile has a speed V. The munitions are then separated and are subjected to their own ballistics before hitting are ground around a point E which corresponds the target aimed at.

Preferably, the sequencer means provided in the projectile enable the durations of the propelled phase, the ballistic phase and the braking phase to be chosen in such a manner that at the end of tbe braking phase (i.e. at the scatter point D), the projectile is at height h and at a distance a from the target with the modulus and direction of its velocity vector being as close as possible to set values which are independent from the situation of the firing point A. FIG. 6 thus shows two other possible trajectories A'B'C'DE and A''B''C''DE corresponding to different firing ranges x but for which the various phases are so sequenced in each case as to ensure that the path from the scatter point D onwards is practically identical.

This characteristic is particularly useful in ensuring excellently reproducible scattering from one shot to the next regardless of the range.

Figure 7:
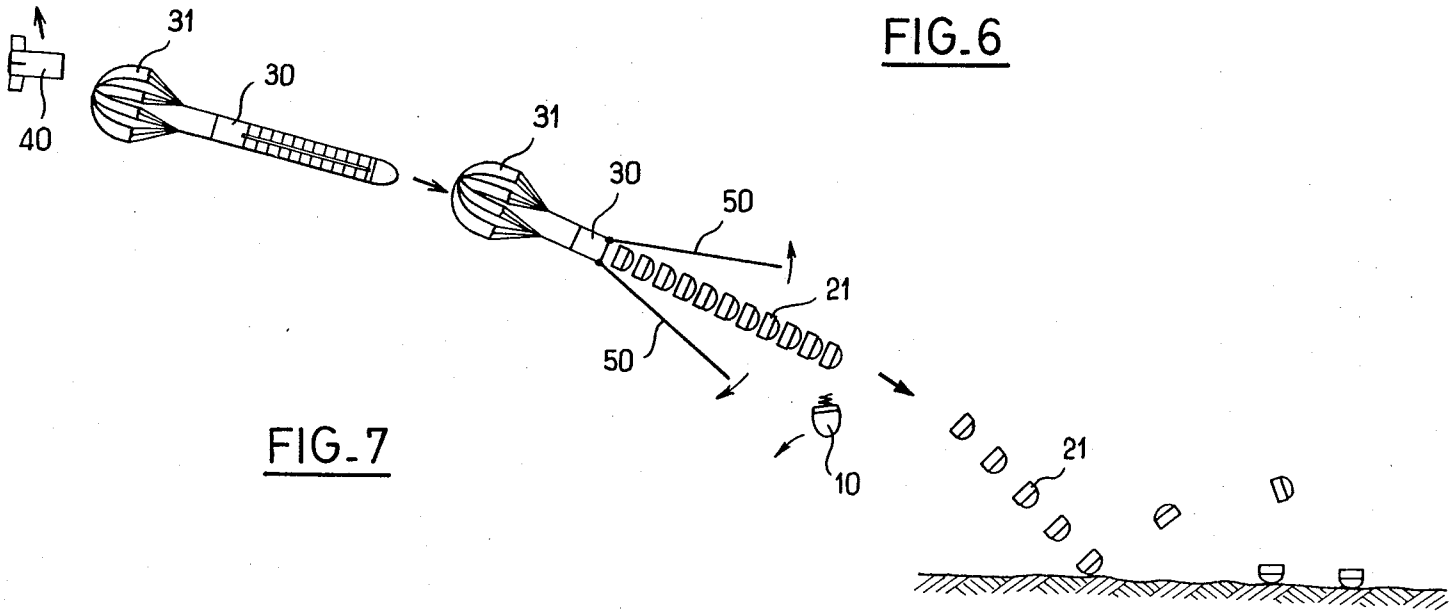
FIG. 7 shows various states of the projectile and the munitions between the beginning of braking and ground impact.

FIG. 7 shows the state of the projectile during these various phases: at the end of the ballistic phase (point C) the propulsion unit 40 is separated from the base element 30 by the extractor means 33. Simultaneously, the parachute 31 opens (left of FIG. 7) thus reducing projectile speed.

At the scatter point D (middle of FIG. 7), the arms are unlocked by ejecting the nose end pins. The nose cone 10 is then ejected and the arms 50 move apart releasing the stack of munitions 21.

The arms may open naturally, or else they may be assisted by mechanical spring means, pyrotechnical means, etc. . . .

The mines may optionally be scattered by separator means or causing relative axial or transverse (or both) displacements of the mines after unlocking. These means may, for example, be constituted by springs disposed between adjacent mines or by a strap passing under the stack and having its ends connected to the top ends of the arms. As the arms move apart (either naturally or with assistance) the strap is stretched thereby communicating an extra axial impulse to the munitions.

After separation, the munitions hit the ground, bounce, and finally come to rest in a mining zone (right hand side of FIG. 7).

Figure 8:
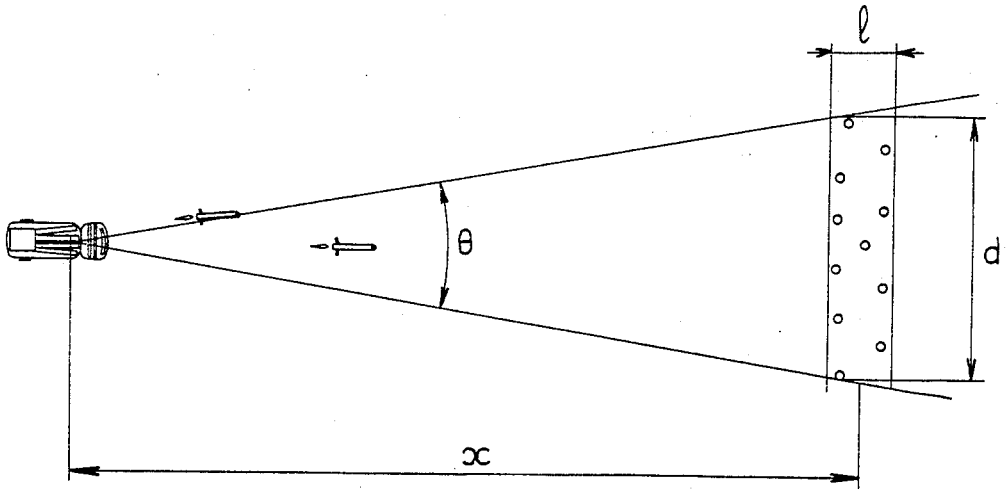
FIG. 8 is a plan view showing the configuration of the mined zone relative to the firing point.

The mining zone is shown very schematically in a plan view of FIG. 8. By virtue of the chosen sequencing, the depth l may be very narrow and substantially independent of the range x. The width d of the mining zone in a transverse direction is a function of the firing angle $\theta$ between the various projectiles of the present type which are used.

We claim:

1. A projectile for scattering munitions, wherein the projectile comprises:

a plurality of individual munitions axially aligned in a separable manner, said munitions being generally flat in shape and having shaped confronting surfaces which are complementary to enable the adjacent munitions to interfit;

a nose element disposed at one end of the axially aligned munitions;

a base element disposed at the other end of the axially aligned munitions;

maintaining means for fixing the aligned munitions, the base element, and the nose element together in a structural stack in which the munitions participate as load carrying members thereby assisting in retaining the stack undeformable against axial and transverse forces in flight and providing an integrated, self-supporting structure constituting the structural body of the projectile;

said structural stack being defined by an outer diameter formed solely by the outer surface portions of the aligned munitions and the diametrically outer extremeties of said nose and said base elements to thereby exclude the use of an external casing means;

and release means connected with the maintainin means for simultaneously unfixing all the munitions from one another and releasing the munitions from load carrying relationship in the structural stack to enable them to be scattered over a target area.

2. A projectile according to claim 1, further including means for preventing relative rotation between individual munitions, at least in one direction about the axis of the stack, in such a manner as to ensure the transmission of torque along the stack and to spread out centrifugal forces applied to the projectile.

3. A projectile according to claim 1, further including means for preventing relative rotation between individual munitions and the end elements, at least in one direction about the axis of the stack, in such a manner as to ensure the transmission of torque along the stack and to spread out centrifugal forces applied to the projectile.

4. A projectile according to claim 1, wherein the maintaining means connects each munition to the adjacent munitions in a manner which is separable under the control of the release means.

5. A projectile according to claim 1, wherein the release means include pyrotechnic means.

6. A projectile according to claim 1, wherein the base element is the base element of an artillery projectile.

7. A projectile according to claim 1, wherein the base element includes a braking parachute.

8. A projectile according to claim 1, wherein a propulsion unit is connected with the base element.

* * * * *